United States Patent [19]

McGourty et al.

[11] Patent Number: 4,815,871

[45] Date of Patent: Mar. 28, 1989

[54] HEAD CONTROL APPARATUS

[75] Inventors: Thomas K. McGourty; Lawrence F. McGourty, both of Pas Robles, Calif.

[73] Assignee: Varitronic Systems, Inc., Minneapolis, Minn.

[21] Appl. No.: 934,644

[22] Filed: Nov. 25, 1986

Related U.S. Application Data

[63] Continuation-in-part of Ser. No. 931,430, Nov. 14, 1986, abandoned.

[51] Int. Cl.[4] ..... B41J 3/20

[52] U.S. Cl. ..... 400/120; 400/356; 400/231

[58] Field of Search ..... 400/120, 208, 234, 356, 400/613, 613.1, 615.2, 618, 619, 621, 225, 231, 236, 236.2; 346/76 PH

[56] References Cited

U.S. PATENT DOCUMENTS

| | | | |
|---|---|---|---|
| D. 283,628 | 4/1986 | Hagiwara . | |
| 1,090,128 | 3/1914 | Avers . | |
| 1,317,404 | 9/1919 | Thomas . | |
| 3,604,549 | 9/1971 | Caudhill et al. . | |
| 3,632,052 | 1/1972 | Read . | |
| 3,643,779 | 2/1972 | Anderson et al. . | |
| 3,682,407 | 8/1972 | Lichtenstein et al. . | |
| 3,691,921 | 9/1972 | Isbell . | |
| 3,804,227 | 4/1974 | Cappotto et al. . | |
| 3,814,231 | 6/1974 | Cappotto . | |
| 3,823,808 | 7/1974 | Murata et al. . | |
| 3,894,507 | 7/1975 | Koechlin . | |
| 3,897,866 | 8/1975 | Mueller . | |
| 3,994,383 | 11/1976 | Best . | |
| 4,083,444 | 4/1978 | Salto . | |
| 4,140,407 | 2/1979 | Porterfield et al. . | |
| 4,145,146 | 3/1979 | Ohkawara et al. . | |
| 4,210,403 | 7/1980 | Mazouet et al. . | |
| 4,239,399 | 12/1980 | Johnstun . | |
| 4,402,619 | 9/1983 | Paque et al. . | |
| 4,419,175 | 12/1983 | Bradshaw et al. . | |
| 4,468,139 | 8/1984 | Hattori | 400/234 |
| 4,479,730 | 10/1984 | Yoshioka et al. . | |
| 4,480,933 | 11/1984 | Shibayama et al. | 400/619 |
| 4,511,903 | 4/1985 | Miyazaki et al. . | |
| 4,527,172 | 7/1985 | Nagashima et al. | 400/120 |
| 4,544,293 | 10/1985 | Cranston et al. | 400/621 |
| 4,660,053 | 4/1987 | Tsutsumi et al. | 346/76 PH |

FOREIGN PATENT DOCUMENTS

| | | | |
|---|---|---|---|
| 105136 | 11/1984 | European Pat. Off. . | |
| 2157919 | 6/1987 | Fed. Rep. of Germany . | |
| 127179 | 7/1985 | Japan | 400/120 |
| 1455915 | 3/1974 | United Kingdom . | |
| 800638 | 8/1958 | United Kingdom . | |

OTHER PUBLICATIONS

Ricoh K.K. and Akio Niki, "Ribbon Feed Amount Change Over Control System for Printer," Abstract of JP Patent No. 56-13193.

Ricoh and Kazuo Hosoi, "Printing Machine," Abstract of JP Patent No. 57-74181.

Canon K.K. and Sadao Iwakura, "Ribbon Feeder", Abstract of JP Patent No. 58-55281.

Canon K.K. and Shiyuiji Ichimura, "Printer," Abstract of JP Patent No. 58-63494.

Matsushita Denki Sangyo K.K. and Yasushi Okamura, "Printer", Abstract of JP Patent No. 59-93376.

IBM Technical Disclosure Bulletin, vol. 25., No. 4.

*Primary Examiner*—David A. Wiecking

*Attorney, Agent, or Firm*—Merchant, Gould, Smith, Edell, Welter & Schmidt

[57] ABSTRACT

A head control apparatus is disclosed for a printing machine. The apparatus includes a frame with a thermal head connected to the frame. A tape roller guide is connected to the frame. The guide and the head are disposed on opposite sides of an intended tape pathway, The guide and head are both movable between first and second positions with the guide and head in the first positions being spaced apart a first distance sized to freely position a tape within the intended pathway. The guide and the head in the second positions are disposed to be closely adjacent with a tape within the pathway being urged against the head. The drive for the image source type is disconnected when the guide and head are separated.

26 Claims, 9 Drawing Sheets

HEAD CONTROL APPARATUS

CROSS REFERENCE TO RELATED APPLICATIONS

This is a Continuation-in-Part application of our commonly assigned U.S. patent application Ser. No. 931,430, filed Nov. 14, 1986 now abandoned and entitled "Head Control Apparatus". This application hereby incorporates by reference the disclosures of our co-pending and commonly assigned applications filed on even date herewith with the following titles:

U.S. patent application Ser. No. 934,650, entitled "Tape Cartridge", which is a Continuation-in-Part application of our U.S. patent application Ser. No. 931,303, filed Nov. 14, 1986 now abandoned and entitled "Tape Cartridge".

BACKGROUND OF THE INVENTION

I. Field of the Invention

This invention relates generally to printing or typing equipment involving the use of a direct thermal printing process or thermal transfer process to transfer a dry film impression onto an image carrying tape. More particularly, this invention pertains to an apparatus for controlling a thermal head associated with the printing machine.

II. Background of the Invention

In the field of commercial art, there is a significant need for a simple means for transferring prefabricated letters or characters to a "paste-up" sheet for later photographing and printing. The earliest technology involving letter transfers was that of dry rub-on transfer sheets which had a series of characters preprinted thereon. These materials, however, are limited by the number of characters available on the sheet and must be very carefully aligned to produce acceptable images. Machines were later developed which printed such letters on a continuous adhesive tape. The first such machines employed print disks having raised characters and used impact printing to transfer pigment to a carrier tape. Some machines were keyboard driven while others were manual "spin and print" machines. See, for example, U.S. Pat. Nos. 3,912,064, 4,243,333, 4,462,708 and 4,579,056.

The impact printing machines mentioned above had many advantages over the rub-on letters, but still suffered from certain limitations. Specifically, these machines were necessarily complicated, heavy, and relatively slow since the printing effect was accomplished by using physical force against the type face with the print media and pigment ribbon in between. Such machines were also restricted to pigment transfer of some form. In addition, an expensive type disk had to be molded for every point size, type style and language, leading to enormous costs in creating a suitable library. Certain foreign languages which are written either "backwards" or vertically would require very specialized type disks. Speed was further limited because the type disks had to physically move to a new location to print each successive character. Finally, the resulting output was generally not considered smear proof and would have to be further coated if used in areas where frequent contact with the print surface was anticipated.

Thermal transfer printing, such as that known in inexpensive portable typewriters (Canon Typestar 5 TM, etc.), employed a new technology which used a heat generating print head to melt a wax-like pigment from a carrier ribbon to a receiving tape. By using digital technology, characters could be formed of a series of pixels and no print disk was required. A related technology is direct thermal printing where an image is created on a thermally sensitive receiving paper directly by the head without the use of an intermediate carrier ribbon.

The key element in a direct thermal or thermal transfer system is the head, its alignment mechanism and the feeding device which precisely moves the receiving tape in synchronization with the activation of pixel elements on the head. In the above-mentioned typewriter devices, the pixel density is so low that only draft quality print is created and, thus misalignment of the head is not particularly serious. In the graphic arts, however, a much higher degree of accuracy for head alignment, paper feed and pixel density is required. This combination of circumstances creates special problems not previously encountered.

In thermal transfer, the pigment carrying tape is typically quite thin and fragile and, thus its surface must be well protected from mishandling by the user. Prior art devices such as the above-mentioned typewriter have employed cartridges, but they did not fully protect the ribbon from damage. The present invention solves this problem of damage to the tape and ribbon, as well as maintaining same in precise alignment.

An additional problem encountered in direct thermal and thermal transfer is the alignment of the head which is routinely exposed to the user. If the head is rigidly mounted so as to be accurately positioned, the mount may be damaged by the user. If the head is on a movable mount, it may not always return to its proper position. The present invention solves this problem by creating a mount which is both flexible, to resist damage, and designed to accurately return to its proper position. In addition to head alignment, the drive rollers which advance the tape must maintain accurate alignment despite the need for their retractability. The present invention likewise solves this problem.

In a printing apparatus, it is desirable to provide a mechanism to control the thermal head so that the head and its associated guide roller may be spaced apart to easily receive a tape and brought together in proper alignment when a tape is properly positioned between the roller and the head. Such an arrangement will facilitate installation of the tape. With respect to thermal heads, such control apparatus must include means to insure that the head is properly aligned when in its operable position to insure that any printed message is not distorted. Also, such apparatus should include means to permit the head to endure a user inflicted blow without misalignment of the head.

SUMMARY OF THE INVENTION

According to a preferred embodiment of the present invention, a head control apparatus is provided for a printing machine for printing an image on an image receiving tape. The head control apparatus includes a frame and a transfer head connected to the frame. A guide is also connected to the frame. The head and the guide are disposed on opposite sides of a pathway through which a receiving tape is intended to be disposed. The guide and head are disposed on opposite sides of an intended position of the image receiving tape. The guide and the head are movable between first and second positions. When in the first positions, the guide and head are spaced apart a distance sufficient to freely position the tape within the passageway without interference by the guide and head. When in the second positions, the guide and head are disposed for the guide and head to be urged together with the tape held between the head and guide.

DESCRIPTION OF THE PREFERRED EMBODIMENT

1. General Description.

Figure 1:
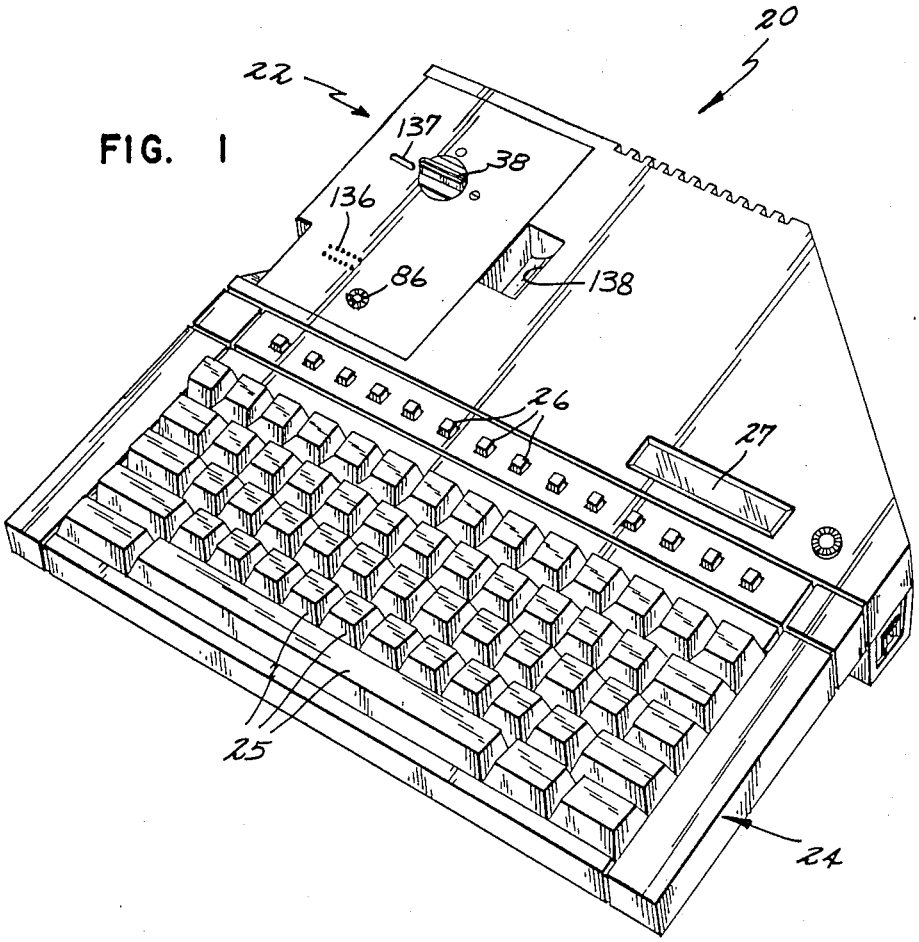
FIG. 1 is a perspective view of a printing machine incorporating the present invention.

Referring to the several figures in which like elements are identically numbered throughout, the preferred embodiment of the present invention will now be described. With reference to FIG. 1, a printing machine 20 is shown together with an associate tape cartridge 22. The printing machine 20 includes a key board portion 24 having a plurality of operator engageable keys 25 and control keys 26. The printing machine 20 further includes a user readable screen 27 to enable an operator to view a message as it is being keyed as well as other messages which may be presented by the machine 20 such as prompts and the like.

In using the machine 20, an operator selects a desired mode of operation and inputs a message through keys 25 in order to produce a tape having the desired message imprinted on the tape. The machine includes electronics (not shown) for accepting the keyed inputs and processing the inputs to generate a desired output. The desired output affects such devices as a thermal head, a tape advance motor, and a tape termination blade all of which will be described. It will be appreciated that the electronics and keyboard mechanism as well as display screen 27 do not form any part of this invention per se and are shown and discussed solely for purposes of background and illustration to enable a reader to understand the interaction of the novel cartridge 22 and novel head control apparatus in a preferred embodiment.

Figure 2:
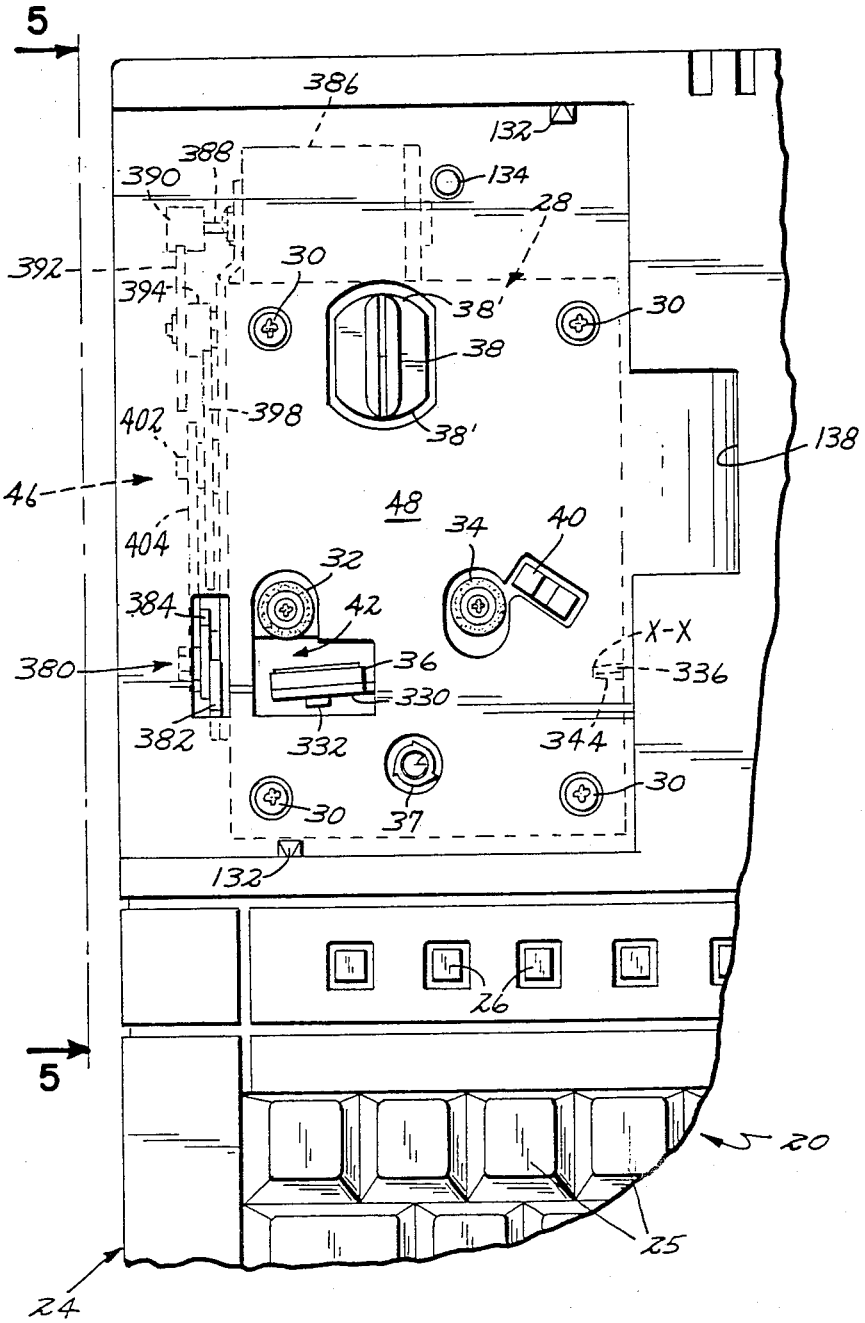
FIG. 2 is an enlarged view of the cartridge receiving area of the printing machine of FIG. 1.

With reference to FIG. 2, the cartridge receiving area of the printing machine 20 is shown with tape cartridge 22 removed thereby exposing machine plate 48 on which cartridge 22 rests in operation. With cartridge 22 removed, a head control apparatus 28 is shown disposed beneath plate 48. Apparatus 28 is secured to the underside of plate 48 by a plurality of screws 30.

Various elements of apparatus 28 protrude through openings in plate 48. These exposed elements include a first guide roller 32, a second guide roller 34, a thermal head 36, a cartridge lock 38, a tape free end detector 40, a scissor cutter 380, a cartridge detection pin 134 and a take-up spool drive sprocket 37. As shown in FIG. 2, first roller 32 and head 36 oppose one another. In the view of FIG. 2, roller 32 and head 36 are shown in their first positions (as shall be more fully described) with roller 32 and head 36 spaced apart to define a pathway 42 therebetween. Pathway 42 is intended to receive a tape. To facilitate understanding of the apparatus, detailed discussion of the head control apparatus 28 will now be deferred pending a more complete description of tape cartridge 22. As will be described, rollers 32, 34 act to guide a tape as well as advance a tape.

2. Detailed Description of Tape Cartridge 22.

Figure 4:
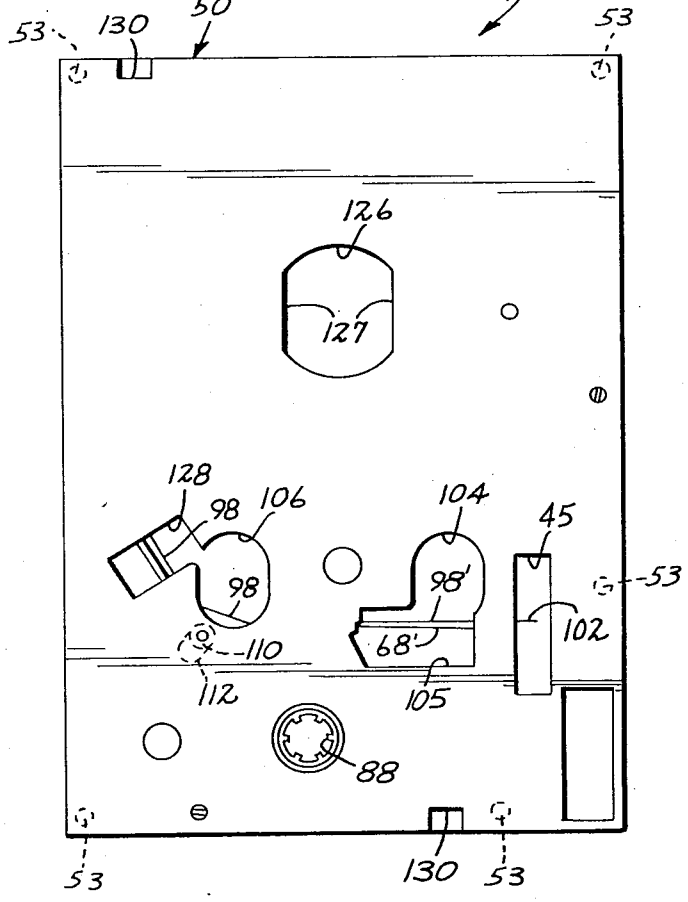
FIG. 4 is a bottom plan view of the cartridge of FIG. 3.
Figure 3:
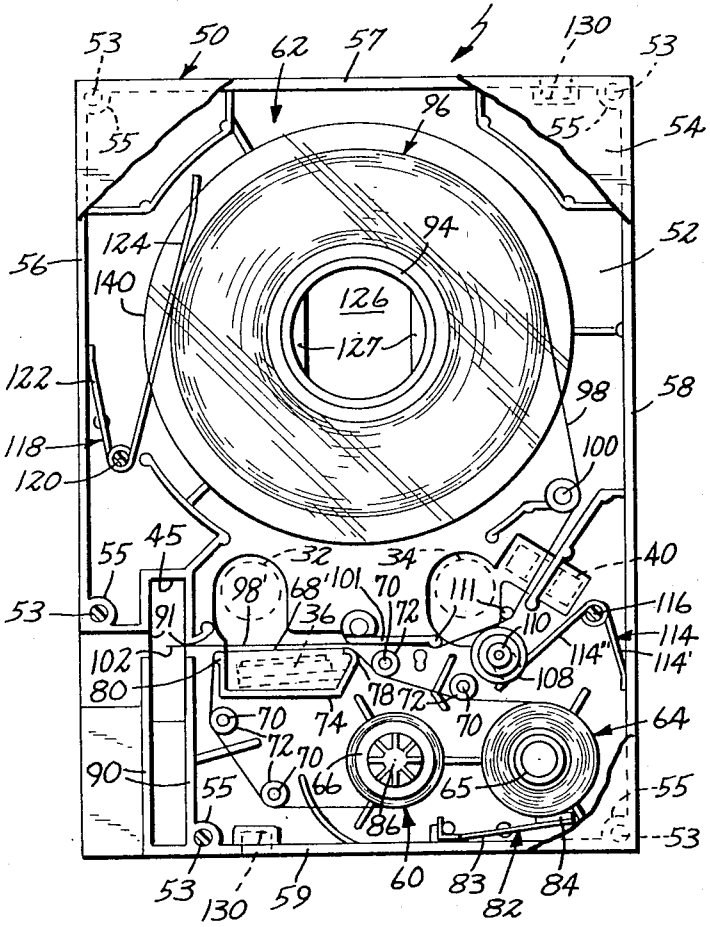
FIG. 3 is a top plan view of a cartridge having an upper plate partially removed to expose the interior of the cartridge.
Figure 5:
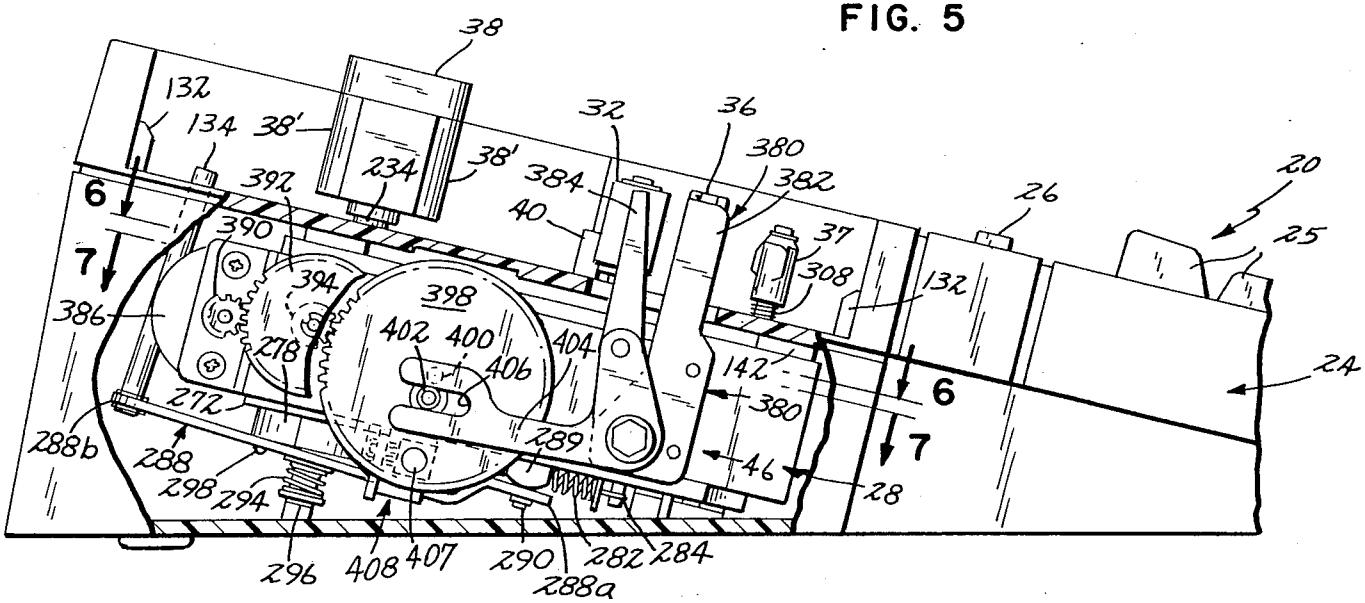
FIG. 5 is a view taken along lines 5—5 of FIG. 2 with a side wall of the printing machine partially removed to expose a tape termination mechanism.
Figure 11:
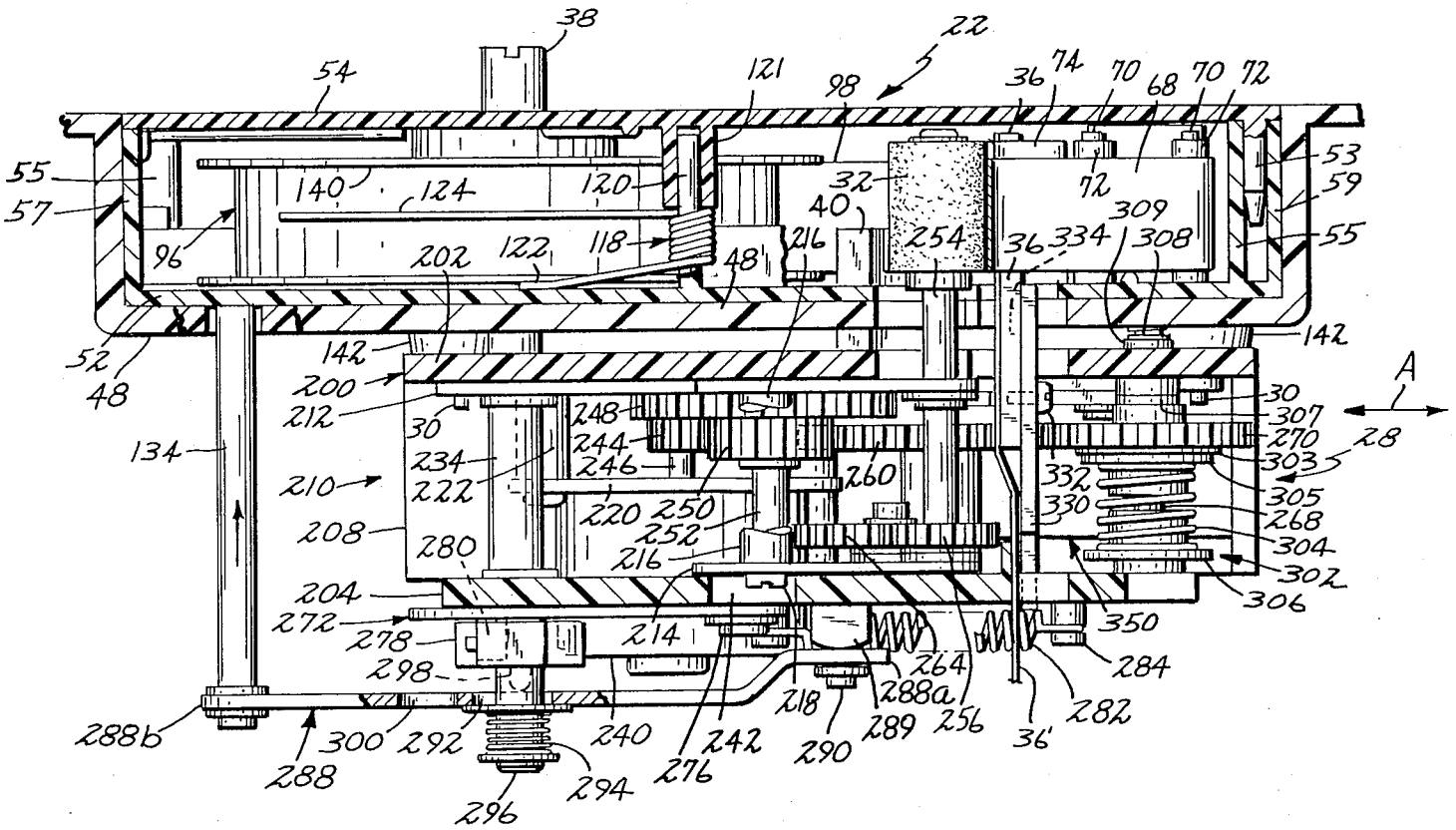
FIG. 11 is a view taken along lines 11—11 of FIG. 6.

With primary reference to FIGS. 3 and 4, tape cartridge 22 is shown as including a generally rectangular shaped housing 50 defined by a flat lower plate 52 and a flat upper plate 54 joined by left and right side walls 56 and 58, respectively (as shown in the view of FIG. 3) and end walls 57 and 59. Side walls 56, 58 and end walls 57, 59 together with plates 52 and 54 cooperate to define a housing interior in which is disposed a first tape system 60 and a second tape system 62. Top and bottom plates 54, 52 are joined with pins 53 of the top plate 54 received within aligned hollow posts 55 of the bottom plate 52 (as shown in FIGS. 2 and 11).

First tape system 60 includes a first tape spool 64 rotatably mounted on a cylindrical hub 65. The first tape system 60 also include a take-up spool 66 rotatably mounted within housing 50. An image source tape 68 is originally carried on first spool 64 and extends therefrom to take-up spool 66. Source tape 68 is entrained around a plurality of alignment pins 70. Each of pins 70 is surrounded by a rotatably mounted cylindrical collar 72.

Cartridge 22 is provided with a wall 74 partially surrounding an opening 105 sized to receive thermal head 36. (In FIG. 3, head 36, first roller 32, second roller 34 and tape free end detector 40 are shown in phantom lines to indicate their positions when the cartridge 22 is mounted on the machine 20. Rollers 32, 34 and head 36 are shown in their first positions.) Wall 74 extends from lower plate 52 toward upper plate 54 and terminates at arcuate ends 78 and 80. Ends 78 and 80 are disposed to receive image source tape 68 and retain a portion 68′ of the tape 68 in predetermined alignment for the portion 68′ to be received within pathway 42 when cartridge 22 is inserted on the machine 20. So inserted, as shown in the phantom lines of FIG. 3, head 36 opposes portion 68′ with a printing substance carrying face of the tape 68 facing away from transfer head 36.

First tape system 60 includes a brake 82 comprising a felt pad 84 resiliently urged against spool 64 by a spring 83 having one end mounted on end wall 59.

Take-up spool 66 includes a hub 86 exposed through upper plate 54 (as shown in FIG. 1) so that hub 86 may be manually engaged by an operator and the take-up spool 66 may be advanced manually if desired. The bottom of take-up spool 66 includes a female sprocket 88 disposed to be received on a male sprocket 37 of the head control apparatus 28 as will be described.

Bottom plate 52 defines an opening 45 on an output side of pathway 42 which is sized to receive scissor cutter 380. Within housing 50, opening 45 is surrounded by walls 90 having openings 91 which act as a housing outlet for second tape system 62 as will now be described.

Second tape system 62 includes cylinder 94 for receiving a spool 96 of an image receiving tape 98. A plurality of pins 100 guide a free end 102 of tape 98 to housing outlet 91. A wall 101 spaced from arcuate end 78 of wall 74 aligns a portion 98' of tape 98 in face-to-face alignment with image source tape portion 68' within pathway 42. Plastic disks 140 are disposed on opposite sides of spool 66 and protect edges of tape 98 during operation of the cartridge 22. The discs 140 reduce friction and helps to prevent the adhesive of the tape 98 sticking to the housing.

Figure 12:
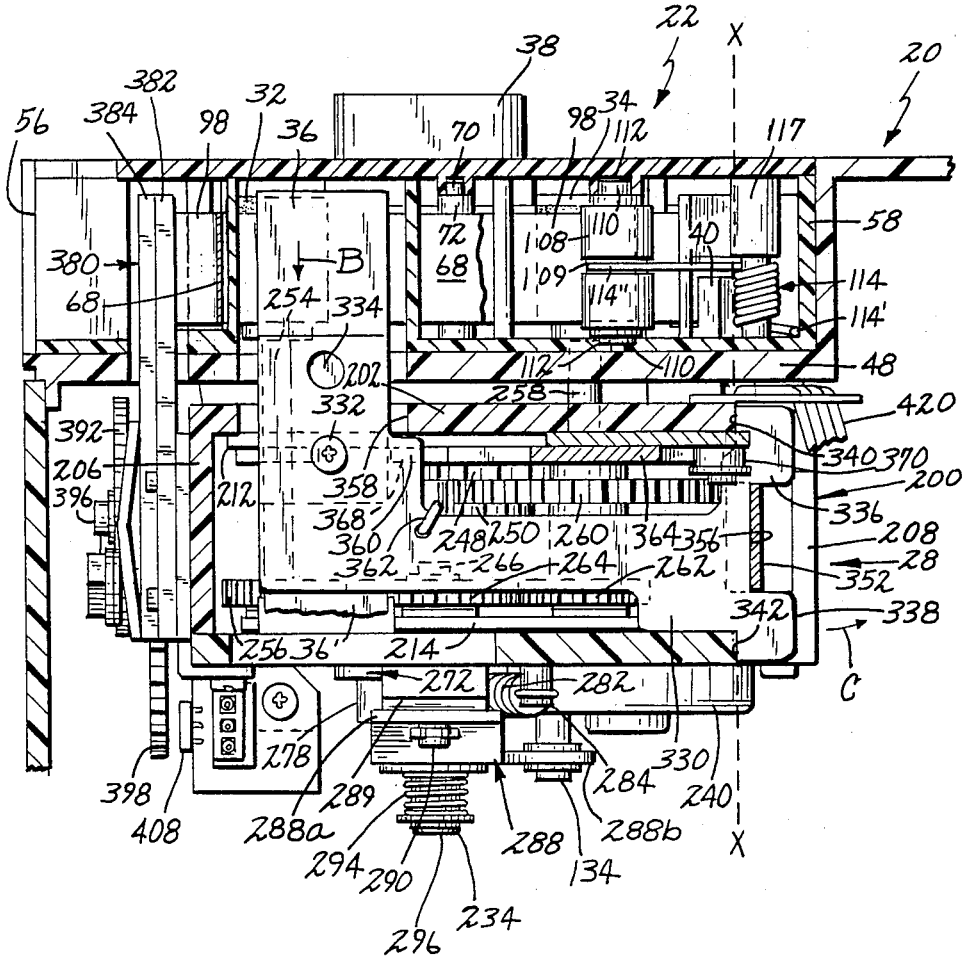
FIG. 12 is a view taken generally along lines 12—12 of FIG. 6.

Second tape system 92 includes a roller 108 for biasing tape 98 against roller 34. Roller 108 is provided with axially extending hubs 110 which are received within elongated slots 112. With hubs 110 received within slots 112, roller 108 is slidable toward and away from roller 34 while retaining the axis of rotation of roller 108 parallel to the axis of rotation of roller 34. A spring 114 entrained around a post 116 is provided with one end 114' urged against side wall 58 and a free end 114" received within a circumferential slot 109 (FIG. 12) in roller 108 with free end 114" urging roller 108 toward roller 34. A brake 118 is provided in the form of a spring entrained around a post 120 with one end 122 acting against side wall 56 and a free end 124 urged against spool 96. Hollow cylindrical posts 117, 121 formed on upper plate 54 are received on pins 116, 120 and retain springs 114 and 118 in proper alignment as shown in FIGS. 11 and 12.

Bottom plate 52 is provided with a generally circular opening 126 which is axially aligned with cylinder 94. Opening 126 is provided with opposing side ledges 127 which cooperate with cartridge lock 38 to lock the cartridge 22 onto machine 20 as will be described.

The bottom plate 52 defines a first guide opening 104 and a second guide opening 106 sized to receive the roller guides 32 and 34, respectively, of the head control apparatus 28. An opening 105 is formed through plate 52 and sized to receive head 36. Openings 104, 106 and 105 are dimensioned to permit relative movement of guides 32, 34 and head 36 as will be described. Lower plate 52 is also provided with an opening 128 sized to receive tape free end detector 40 when cartridge 22 is mounted on machine 20 in a predetermined alignment.

Lower plate 52 is provided with offset notches 130 sized to receive offset posts 132 (shown in FIG. 2) projecting from the machine 20. With cartridge 22 aligned with machine 20 such that notches 130 are aligned with posts 132, cartridge 22 is in proper alignment with the machine and may be placed in its proper position such that guide rollers 32, 34 are received within openings 104, 106, respectively, and head 36 is received within opening 76 with tape portions 68', 98' received within pathway 42. Further, with cartridge 22 properly aligned and in position, tape free end detector 40 is received within opening 128 and male sprocket 37 is operably received within female sprocket 88. Additionally, scissor cutter 380 is received within opening 45. With bottom plate 52 of a cartridge 22 urged against the top surface of the machine plate 48, detection pin 134 will be depressed as described. Also, cartridge lock 38 may be turned 90° clockwise from the position shown in FIG. 2 such that its rounded edges 38' are received overlying side ledges 127 to thereby capture bottom plate 52 between the machine plate 48 and cartridge lock 38.

The upper plate 54 is provided with a plurality of vent openings 136 shown in FIG. 1. Vent openings 136 are disposed above the intended position of head 36. Additionally, a slot 137 is formed in upper plate 54 projecting radially away from cylinder 94. Slot 137 enables a user to determine the amount of tape left on spool 66. A notch 138 formed in apparatus 20 adjacent the intended position of cartridge 22 enables the operator to grasp cartridge 22.

The foregoing description of cartridge 22 is a description of a first preferred embodiment. In the first preferred embodiment, the cartridge includes both first tape system 60 and second tape system 62. Second tape 98 is a tape intended to receive an image by means of a printing substance transferred from image source tape 68 to image receiving tape 98. This process is known as thermal transfer printing. The tranfer occurs by reason of thermal head 36 being selectively heated and thereby melting a point on the source tape 68 onto the receiving surface of tape 98. The head is a thermal head having a plurality of individually controlled pixels disposed in an array perpendicular to the direction of travel of the tapes. In a preferred embodiment, head 36 will have 96 pixels disposed in a density of 240 pixels per inch. The circuitry of the machine 20 can individually heat each of the pixels so that any possible permutation of the 96 pixel array may be heated to transfer the image of the permutation to the receiving tape 98 by melting the permutation from the source tape 68 to receiving tape 98. It will be appreciated that thermal heads such as head 36 and circuitry for controlling the heads form no part of this invention per se and are described to facilitate an understanding of the novel tape cartridge 22 and head control apparatus 28.

In addition to the first preferred embodiment of melting an image from the source tape 68 to the receiving tape 98, the present invention is suitable for use where the image receiving tape 98 receives the image by directly "burning" an image from the head 36 to the receiving tape 98. This process is known as direct thermal printing. In this embodiment, the spool 64 of image source tape 68 is not needed and is simply eliminated from the cartidge 22.

3. Detailed Description of Head Control Apparatus 28.

a. Frame 200 and Movable Carriage 210

Head control apparatus 28 includes a hollow box-shaped frame 200 including a flat top plate 202 and a flat bottom plate 204 which are spaced apart by left and right side walls 206, 208 (as shown in the view of FIG. 12). Frame 200 is secured to machine 20 by attaching top plate 202 to the under surface of machine plate 48 by screws 30. Frame top plate 202 is maintained in spaced relation from machine plate 48 by spacers 142 (shown in FIG. 11).

Disposed within the interior of the box-shaped frame 200 is a carriage 210 shown best in FIG. 11. Carriage 210 includes an upper carriage plate 212 which slidably abuts an interior surface of frame top plate 202. Carriage 210 further includes a lower plate 214 which slidably abuts an interior surface of frame bottom plate 204. A spacer bar 216 (shown broken away in FIG. 11) is secured to upper plate 212 and extends to lower plate 214.

Lower plate 214 is secured to spacer bar 216 by means of screw 218.

A motor mount plate 220 is secured to carriage 210 by means of a first motor mount support bar 222 extending from carriage upper plate 212 to motor mount plate 220 and a second motor mount support bar 224 also extending from carriage upper plate 212 to a second end of motor mount plate 220. A third motor mount support bar 226 extends from the motor mount plate 220 coaxially with second support bar 224 and is secured to carriage lower plate 214 by means of screw 228 (shown in FIGS. 9 and 10).

Spacer bar 216, motor mount plate 220 and motor mount support bars 222, 224 and 226 maintain upper plate 212 in spaced relation from lower plate 214 with carriage 210 slidably received within the interior of frame 200.

Figure 6:
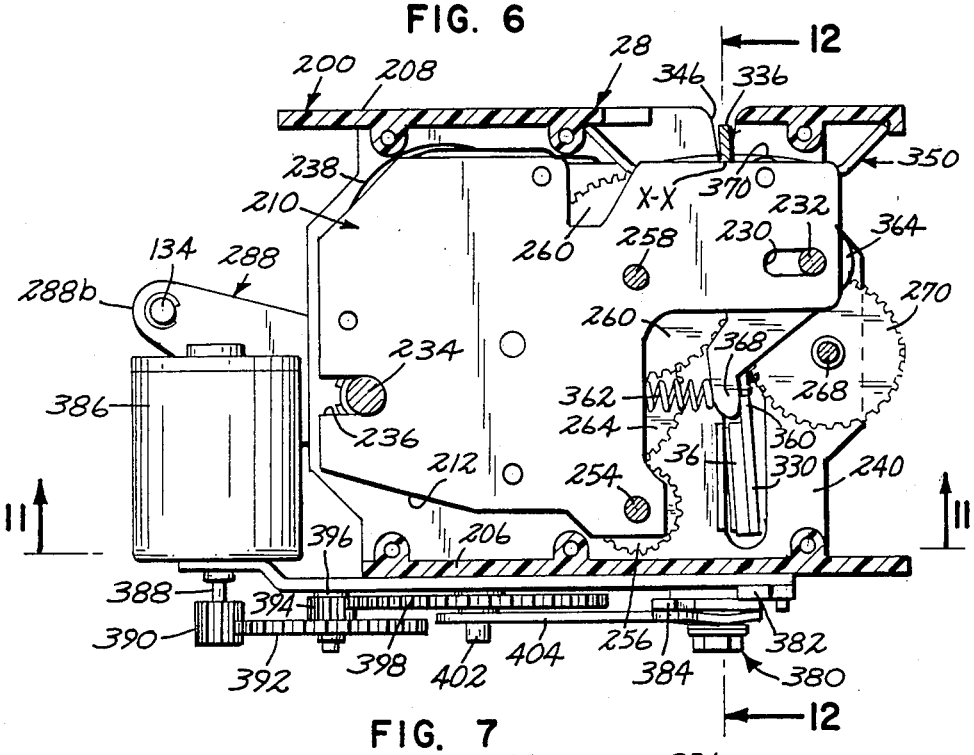
FIG. 6 is a view taken along lines 6—6 of FIG. 5.

Carriage 210 is slidable within frame 200 in the direction of arrow A shown in FIG. 11. To guide carriage 210 and to limit its slidable stroke, upper plate 212 is provided with an elongated slot 230 which receives a pivot pin 232 which extends inwardly into frame 200 from frame top plate 202. Slot 230 and pin 232 are shown best in FIG. 6. Lock control shaft 234 extends vertically (in the view of FIG. 11) through frame 202 and machine plate 48 and is journalled for rotation about its axis within top frame plate 202 and bottom frame plate 204. As shown in FIG. 6, upper carriage plate 212 is provided with a slot 236 sized to receive control shaft 234. Slot 236 and shaft 234, together with slot 230 and pin 232, cooperate to restrain the sliding movement of carriage 210 in the direction of arrow A and to limit the stroke of the carriage between a first location with the right hand ends of the slots 230, 236 abutting pin 232 and shaft 234, respectively (as shown in FIG. 6) and a second position with a left hand end of slot 230 abutting pin 232 (references to left and right taken in the view of FIG. 6).

b. Motor 240 and Gear Train

A motor 240 is mounted on motor mount plate 220 and is provided with a driving gear 244 carried on an end of the motor shaft 246. Motor 240 is a rotary digital actuator which, on receipt of a signal, rotates in discreet angular displacements. As shown best in FIGS. 9 and 10, bottom frame plate 204 includes an opening 238 sized to accommodate unrestricted movement of motor 240 and screw 228 which extend beneath the bottom of lower carriage plate 214. A slot 242 in bottom frame plate 204 accommodates reciprocal movement of screw 218 as the carriage 210 moves between its first and second locations. Motor 240 is secured to motor mount plate 220 for movement therewith as the carriage 210 moves between the first and second locations Shown best in FIGS. 7, 11 and 12, the carriage 210 includes a gear train which is mounted on the carriage 210 for movement therewith. The gear train includes the motor driving gear 244. The carriage gear train further includes integrally connected first intermediate transfer gear 248 and second intermediate transfer gear 250 which are mounted for simultaneous rotation on a common fixed shaft 252 which extends between upper and lower carriage plates 212, 214. First intermediate transfer gear 248 is disposed to mesh with driving gear 244.

A first rotary shaft 254 is journalled through the carriage upper plate 212 and carriage lower plate 214 and extends through frame top plate 202 and machine plate 48. First roller 32 is connected to first rotary shaft 254 for rotation therewith. A first roller gear 256 is connected to first rotary shaft 254 to cause rotation of shaft 254 as gear 256 is rotated about its axis.

A second rotary shaft 258 is journalled through the carriage upper plate 212 and carriage lower plate 214 and extends through frame top plate 202 and machine plate 48. Second roller 34 is secured to shaft 258 for rotation therewith. Shaft 258 carries a driven gear 260 which is enmeshed with second intermediate transfer gear 250. An integrally connected drive gear 262 is carried on shaft 258 to rotate as gear 260 is driven by gear 250. Gear 262 is aligned in a common plane with first roller gear 256.

Figure 7:
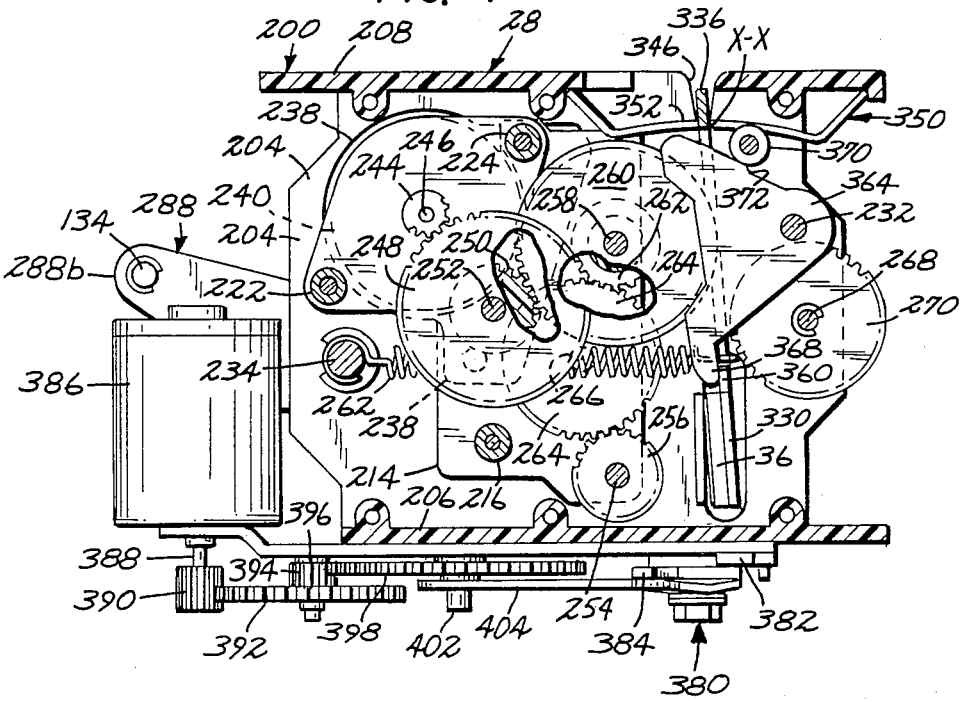
FIG. 7 is a view taken along lines 7—7 of FIG. 5 showing a head control apparatus with a head in a first position.

An idler gear 264 is mounted on a fixed shaft 266 between gears 262 and 256. Gear 264 is enmeshed with both of gears 262 and 256 for gear 264 to drive first roller gear 256 as second roller gear 262 is driven. In the view of FIG. 7, portions of gears 248 and 260 are broken away to illustrate meshing of gear pairs 250, 260 and 262, 264.

Figure 8:
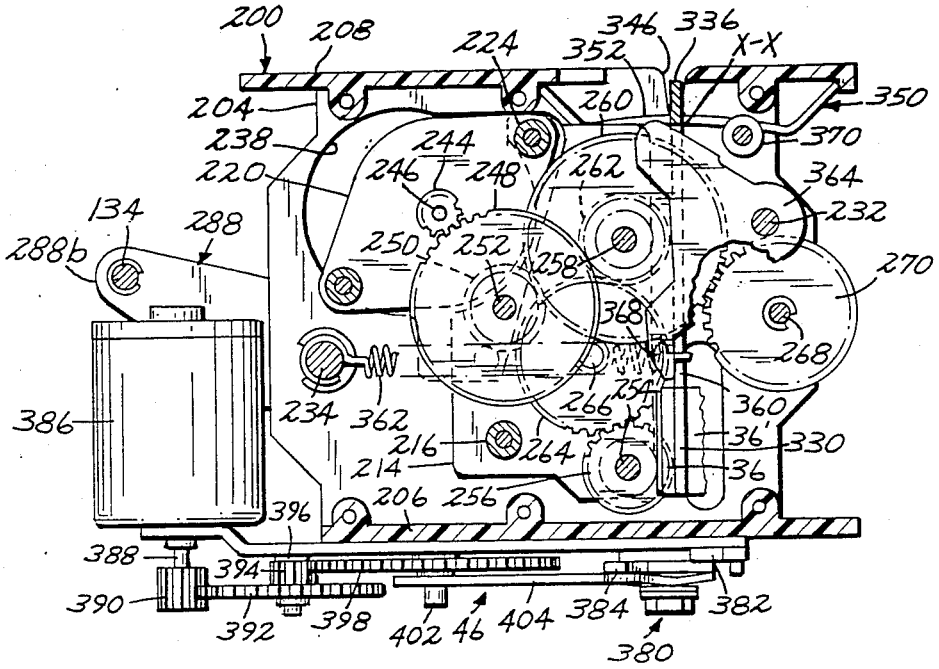
FIG. 8 is the view of FIG. 7 showing a head control apparatus with the head in a second position.

As shown in FIGS. 5, 6–8 and 11, male sprocket 37 is mounted on a rotary shaft 268 which is journalled between frame top plate 202 and frame bottom plate 204. Shaft 268 carries a driven gear 270 which is mounted on shaft 268 for rotation therewith. Gear 270 is aligned in a common plane with gear 260. As shown best in FIGS. 7 and 8, gears 260 and 270 are disposed such that when carriage 210 is in the first location (as depicted in FIG. 7), gear 260 and gear 270 are disengaged. When carriage 210 is shifted to the second position (as depicted in FIG. 8), gear 260 and gear 270 are enmeshed for gear 260 to drive gear 270.

Having described the gear train, it can be seen that as motor shaft 246 rotates in a clockwise direction (when viewed in FIG. 7), gear 244 rotates in a clockwise direction, urging gears 248 and 250 to rotate in a counter-clockwise direction. Gear 250 urges gear 260 to rotate in the clockwise direction with the corresponding rotation of gear 262 in a clockwise direction. Gear 262 urges gear 264 to rotate in the counter-clockwise direction, which in turn urges gear 256 to rotate in the clockwise direction. When the carriage 210 is shifted to the second location (as depicted in FIG. 8), gear 260 urges gear 270 to rotate in the counter-clockwise direction.

As a result of the gearing arrangement, the gear train, upon actuation of motor 240, causes first and second rollers 32, 34 to rotate in the clockwise direction, when viewed in FIG. 2. When the carriage 210 is in the second position (the position of FIG. 8), the gear train urges the male sprocket 37 to rotate in the counter-clockwise direction when viewed in FIG. 2.

As the carriage 210 moves between its first and second locations, rollers 32, 34 move between first and second predetermined positions. In the view of FIG. 2, the rollers 32, 34 are shown in the first positions with the rollers spaced away from the intended position of the tape portions 68', 98'. When the carriage 210 is moved to its second location, the roller 32 is moved toward head 36 and roller 34 is moved toward cassette roller 108. FIG. 11 shows the carriage 210 in the second location with roller 32 against head 36. Roller shafts 254, 258 extend through openings formed in frame top plate 202 and machine plate 48. The openings are elongated to accommodate movement of the shafts 254, 258 between their first and second positions.

Roller 32 and head 36 are disposed so that when in the second position the center line of roller 32 is accurately aligned with the pixel array of head 36. Small deviations from accurate alignment will result in failure of the head 36 to properly transfer an image onto the tape 98.

c. Carriage Movement Control

To effect movement of the carriage 210 between its first and second locations, an over-center locking mechanism 272 is provided which is best shown in FIGS. 5, 9, 10 and 11. Over-center locking mechanism 272 includes a flat cane-shaped linkage 274 having a straight end 275 pivotally mounted to carriage upper plate 214 by means of a pivot pin 276. A curved end 277 of linkage 274 is sized to extend and curve around lock control shaft 234. A linkage arm 278 is secured to control shaft 234 for rotation therewith. Linkage arm 278 includes a pivot pin 280 which pivotally connects link arm 278 to cane-shaped linkage 274 on a pivot axis spaced away from the axis of shaft 234.

Figure 9:
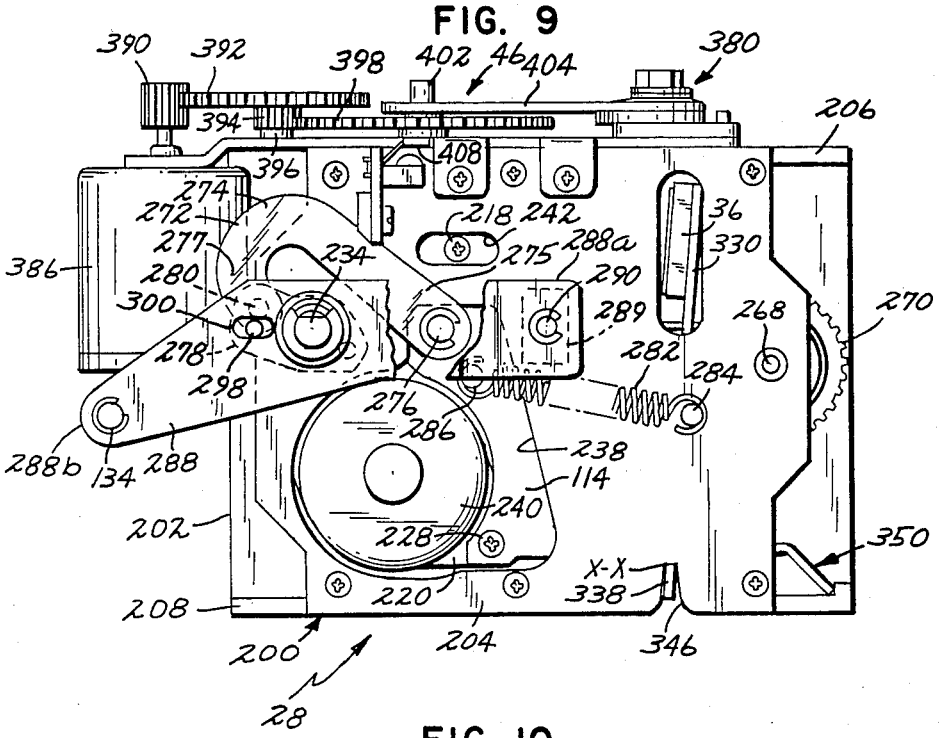
FIG. 9 is a bottom plan view of a head control apparatus showing the head in the first position.

With the structure thus described, carriage 210 is moved to the first location (as shown in FIG. 9) by turning shaft 234 in a clockwise direction (when viewed in FIG. 9) with the result that linkage 274 is pivoted away from the center of shaft 234 urging carriage 210 to move to the right (when viewed in FIG. 9). When shaft 234 is rotated in a clockwise direction, pivot pin 280 carries the cane-shaped linkage 274 around shaft 234, as viewed in FIG. 10, with the result that carriage 210 is moved to the left and assumes its second location.

A spring 282 is provided for urging the carriage 210 to its first location. Spring 282 includes a first end which is secured to a pin 284 which is rigidly connected to the frame bottom plate 204. A second end of spring 282 is connected to a pin 286 which is rigidly connected to the carriage lower plate 214 and extends through opening 238.

d. Carriage Lock Mechanism

Figure 10:
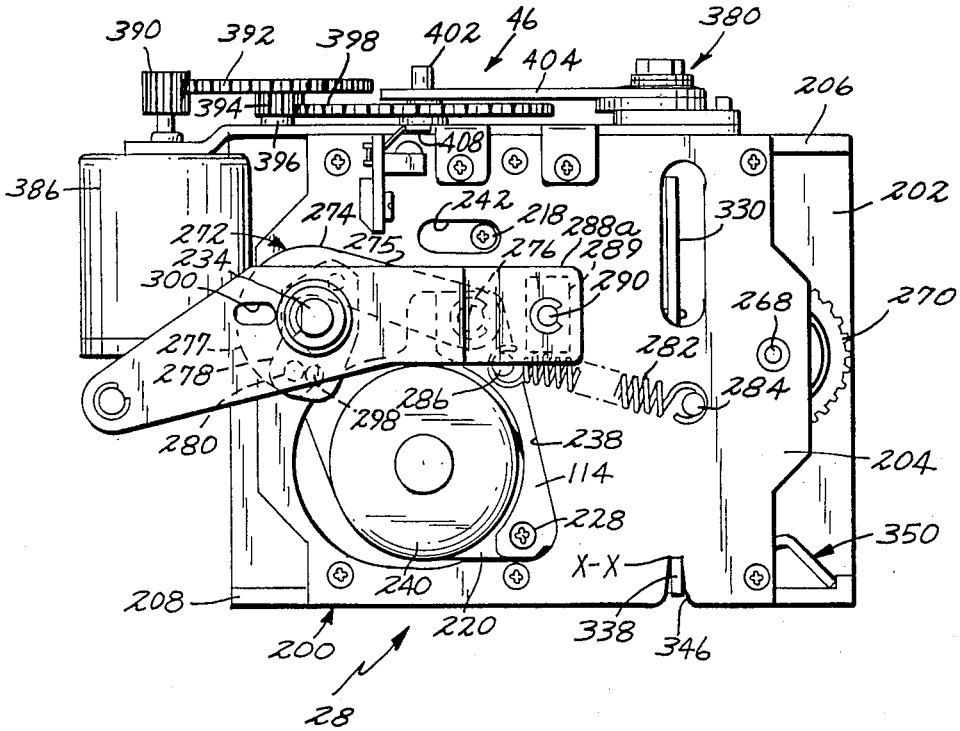
FIG. 10 is the view of FIG. 9 showing the head in the second position.

To insure that carriage 210 will be in the first position when a cartridge is not mounted on the machine, a lock mechanism is provided which is best shown with reference to FIGS. 9 through 11. The lock mechanism includes a lever arm 288 having a first end 288*a* hingedly mounted on a fulcrum 289 carried on frame bottom plate 204 by a pin 290. A free end 288*b* of pivot arm 288 is connected to detection pin 134 which extends through machine plate 48. A central portion of pivot arm 288 is provided with a first opening 292 which slidably receives control shaft 234. A spring 294 is mounted between arm 288 and a free end 296 of shaft 234. Spring 294 urges arm 288 away from free end 296.

Linkage arm 278 is provided with a stop pin 298. Pivot arm 288 is provided with a slot 300 disposed to receive stop pin 298 when carriage 210 is in its first location (as depicted in FIG. 9). Accordingly, when a cartridge 22 is inserted on the machine in proper alignment, the cartridge 22 moves detection pin 134 downwardly (in the view of FIG. 11). Downward movement of pin 134 moves lever arm 288 against the urging of spring 294 to free pin 298. With pin 298 free of slot 300, an operator may rotate lock control shaft 234 with carriage 210 correspondingly moving to the second location (depicted in FIG. 10).

e. Take-up Spool Slip Clutch

Shown most clearly in FIG. 11, shaft 268 is provided with a slip clutch mechanism 302 to permit gear 270 to rotate without rotation of shaft 268. A first hub 306 is mounted on shaft 268 for rotation therewith. A second hub 305 and gear 270 is loosely received on shaft 268 for relative rotation between shaft 268 and gear 270 and hub 305. A felt disc 303 is disposed between second hub 305 and gear 270. A spring 304 is disposed between first hub 306 and second hub 305 urging hub 305 to rub disc 303 against gear 270. Gear 270 is moved against a snap ring 307 disposed between gear 270 and a bearing 309 for shaft 268. Spring 304 is selected to urge second hub 305 against gear 270 to rotate shaft 268 until resistance of the shaft against further rotation is sufficient to overcome the urging of spring 304. At this point, spring 304 yields to permit relative rotation of shaft 268 and gear 270. A second spring 308 extends above top plate 202 between bearing 309 and male sprocket 37. Second spring 308 permits the male sprocket 37 to be moved downwardly when a cartridge 22 is placed on the machine 20 in the event that the female sprocket 88 is not properly aligned with the male sprocket 37. With the male sprocket 37 moved downwardly, the male sprocket 37 will come into alignment with the female sprocket 88 and spring 308 will urge the male sprocket 37 into engagement with the female sprocket 88.

f. Head Alignment

Head control apparatus 28 includes a head alignment mechanism for accurately aligning head 36 with roller 32. The alignment mechanism is best shown in FIG. 12 and includes a mounting bracket 330. Mounting bracket 330 is generally L-shaped. Head 3 is secured to a first end of mounting bracket 330 by means of a screw 332. The first end of the mounting bracket 330 includes an indent 334 which projects away from the surface of the mounting bracket 330 on a side thereof opposing head 36. Head 36 is provided with a recess sized to receive indent 34. The indent 34 and its associated recess on head 36 together with screw 332 maintain head 36 in accurate fixed alignment with mounting bracket 330.

A second end of mounting bracket 330 is provided with upwardly and downwardly projecting pivot plates 336 and 338, respectively (as shown in the view of FIG. 12). Pivot plates 336, 338 have aligned pivot edges 340, 342, respectively facing in the direction of head 36. Upper and lower pivot plates 336, 338 are received in upper and lower slots 344, 346, respectively formed in frame top plate 202 and frame bottom plate 204, respectively. In the preferred embodiment, plates 202 and 204 are formed of plastic material and the mounting bracket 330 is metallic.

Shown in FIGS. 6–8 and 12, pivot plates 336, 338 are maintained within slots 344, 346 by means of a leaf spring 350 which is carried on the interior surface of frame side wall 208. The leaf spring 350 has an arcuate central portion 352 which is a narrow strip of metal (as shown in FIGS. 6–8). The surfaces of the central portion 352 opposing the bracket 330 are parallel to axis X—X.

As shown in FIG. 12, mounting bracket 330 is provided with a recess 354 centrally disposed between upper pivot plate 336 and lower pivot plate 338. Recess 354 is sized to receive spring body 352 against a face 356 of recess 354. With spring central portion 352 received within recess 354 as described, spring central portion 352 urges the pivot edges 340, 342 of pivot plates 336, 338 into slots 344, 346. Additionally, in response to a downward force imparted on head 36 (indicated by the arrow B), spring central portion 352 permits lower plate 338 to pivot out of slot 346 as indicated by the arrow C. With lower plate 338 pivoting out of slot 346, the pivot axis of the motion occurs at upper pivot edge 340. When the downward force is removed, deformation of spring central portion 352 away from its alignment with axis X—X urges spring central portion 352 back to alignment with consequential urging of lower plate 338 into slot 346.

Head 36 and the first end of the mounting bracket 330 extend through an opening 358 formed in the frame top plate 202. A ledge 360 formed on mounting bracket 330 opposes an inner surface of frame top plate 202 adjacent opening 358. As spring body 352 is urging mounting bracket 330 to restore head 336 in its proper position, ledge 360 abuts frame top plate 202 when head 36 is properly positioned.

A spring 362 extends between mounting bracket 330 and lock control shaft 234 (shown in FIGS. 7 and 8). Spring 362 urges mounting bracket 330 to pivot about axis X—X to move head 36 to its second position with the head 36 resiliently urged against first roller 32.

To move head 36 against the urging of spring 362 to the head's first position, an alignment bracket 364 is provided. Alignment bracket 364 is best shown with reference to FIGS. 7, 8 and 12. Bracket 364 is pivotably secured to frame top plate 202 by means of pivot pin 232. Alignment bracket 364 is provided with a contact element 368 disposed opposing a surface of ledge 360 on a side of mounting bracket 330 facing the direction of urging of spring 362. Contact element 368 is disposed to contact ledge 360 and urge mounting bracket 330 to pivot about axis X—X against the urging of spring 362 as alignment bracket 364 pivots about pin 366 in a counterclockwise direction (when viewed in FIG. 7).

An engagement element in the form of a cam 370 is fixed to upper carriage plate 212 for movement therewith. The cam 370 is disposed opposing a cam follower side edge 372 of alignment bracket 364 to abut the side edge 372 and urge alignment bracket 364 to pivot in a counterclockwise direction (in the view of FIG. 7) as the carriage is moved to its first location (i.e. to the left in the view of FIG. 7). As previously mentioned, upper carriage plate 212 has an elongated slot 230 sized to freely receive pin 232. Slot 230 is provided with a longitudinal dimension sufficient to permit carriage 210 to move between its first and second locations with pin 232 remaining in a fixed position relative to the frame 200 and with slot 230 and pin 232 sliding relative to one another.

g. Tape Termination Apparatus

A termination blade mechanism 46 is provided for terminating a tape after it has received an image from head 36. The termination mechanism 46 includes a scissor cutter 380 mounted on the exterior surface of frame side wall 206. Cutter 380 includes a stationary blade 382 and a cooperating cutting blade 384 pivotably mounted to frame side wall 206. A motor 386 is carried on frame 200 and has a shaft 388 with a driving gear 390. Driving gear 390 is operably connected by means of a gear train to the cutting blade 384 to advance and retract the cutting blade away from stationary blade 382.

The gear train includes first and second gears 392, 394, respectively which are mounted on a common fixed shaft 396 with first gear 392 emmeshed with driving gear 390. A blade actuating gear 398 is mounted by means of a central shaft 400 to the frame 200 with gear 398 emmeshed with gear 394.

Blade actuating gear 398 has a pin 402 eccentrically mounted thereon. Cutting blade 384 includes a linkage 404 having an elongated slot 406 disposed to receive pin 402. As gear 398 rotates about its central axis, pin 402 reciprocally slides within slot 406 causing linkage 404 to rock with consequential movement of cutting blade 384 toward and away from stationary blade 382.

A Hall effect transistor 408 is mounted on frame 200 to detect the presence of target 407 mounted on blade actuating gear 398. Hall effect transistors 408 are known in the art and form no part of this invention per se. Use of Hall effect transistors to detect targets such as target 407 is known. With the transistor 408 and the target 407 on the blade actuating gear 398, the positioning of the cutting blade 384 relative to the stationary blade 382 can be determined. The transistor 408 and motor 386 are connected through conductors (not shown) to the circuitry of the printing machine 220.

4. Operation of Apparatus.

With the structure of the printing machine 20 and the novel tape cartridge 22 and head control apparatus 28 described, a description of the operation of the apparatus will now be provided. With reference to FIG. 2, the head control apparatus 28 is shown in the idle position when a tape cartridge 22 is not inserted onto machine plate 48. In the idle position, cartridge lock 38 is pivoted to a position with its longitudinal direction aligned with the longitudinal direction of plate 48 as shown in FIG. 2. So aligned, rounded edges 38′ are disposed at the top and bottom of cartridge lock 38 as shown in FIG. 2. With cartridge lock 38 so positioned, over-center locking mechanism 272 is pivoted to the position shown in FIG. 9 with carriage 210 disposed to the left (when viewed in FIG. 9) with the carriage 210 assuming its first location. With the carriage 210 in its first location, cam 370 has acted against cam follower side edge 372 of alignment bracket 364 causing contacting element 368 to act against ledge 360 of mounting bracket 330 and urge mounting bracket 330 against the urging of spring 362. With mounting bracket 330 urged to its first position, head 36 is moved to its first position and spaced away from the intended tape pathway 42. Interaction of spring 362, contact element 368 and mounting bracket 330 in the first position are shown in FIG. 7. Also, with carriage 210 moved to the left and in its first location, guide rollers 32 and 34 (which are connected to carriage 210 for movement therewith) are moved to their first positions with roller 32 spaced from intended pathway 42. Finally, with the carriage 210 in its first location as shown in FIG. 9, stop pin 298 is aligned with slot 300 whereby urging of spring 294 causes pivot arm 288 to pivot upwardly (when viewed in FIG. 11) with detection pin 134 extending above machine plate 48.

When it is desired to use machine 20, a tape cartridge 22 is positioned on machine plate 48 with post 132 received within notches 130. With cartridge 22 properly aligned on plate 48, cartridge 22 is pushed by the operator to urge pin 134 downwardly (when viewed in FIG. 11) and pivot arm 288 away from stop pin 298 as shown in FIG. 11. With cartridge 22 held down tightly against surface 48, cartridge lock 38 is engaged by an operator and rotated 90° clockwise (when viewed in FIG. 2) whereby rounded edges 38′ capture ledges 127 of cartridge 22 between the rounded edges 38′ and machine plate 48.

With cartridge 22 locked onto machine plate 48, the apparatus may now be used by an operator to produce a tape with a desired printed image. As shown in FIG. 3, when a cartridge 22 is being positioned on machine 20 and an operator has not yet turned lock 38 from the position shown in FIG. 2, rollers 32, 34 and head 36 are in their first positions. The first roller 32 and head 36 are spaced apart a distance sufficient to permit tape portions 98′ and 68′ to be received within the intended tape pathway 42 without obstruction. Further, with roller 34 in its first position, the cartridge may be installed without obstruction of roller 34 against the tape 98 and cartridge roller 108.

During installation of the cartridge 22 onto machine plate 48, an operator may inadvertently urge the bottom plate 52 of cartridge 22 downwardly onto head 36. In this event, head 36 moves downwardly in the direction of arrow B of FIG. 12 with the result that the entire mounting bracket 330 pivots at upper plate 336 with lower plate 338 moving in the direction of arrow C. When the operator re-adjusts cartridge 22 such that it is properly aligned, head 36 is aligned with cartridge opening 105. When so aligned, spring body portion 352 urges mounting bracket 330 to pivot back to its original position with ledge 360 acting against frame upper plate 202 to positively stop head 36 in its intended aligned position.

As the operator rotates cartridge lock 38 to its intended locked position, over-center locking mechanism 272 pivots to the position shown in FIG. 10 and thereby urges carriage 210 to the right whereby the carriage 210 assumes its second location. As carriage 210 moves to its second location, guide rollers 32 and 34 move to their first positions. Simultaneously, movement of carriage 210 to the right (as shown in FIG. 8) causes cam 270 to move away from cam follower surface 372 of aligning bracket 364. In the absence of the urging of the cam 370, spring 362 urges mounting bracket 330 and head 36 to its first position. With the cartridge 22 installed and with the rollers 32, 34 and head 36 in their first positions, tape portions 68', 98' are snuggly received between roller 32 and head 36 and with head 36 resiliently urging the tape portions against the roller in proper alignment. In the event the cartridge 22 is being used without a source tape 68 and, instead, is being used for direct thermal printing, only an image receiving tape 98 will be disposed between head 36 and roller 32. With roller 34 in its first position, cartridge roller 108, in response to the action of spring 114, resiliently urges tape 98 against roller 34. Finally, with the tape cartridge 22 installed, tape 98 is received within tape free end detector 40 and stationary blade 382 and cutting blade 384 are spaced apart to receive the free end 102 of tape 98 between the blades.

With the tape cartridge 22 installed as described, the machine is ready for use by an operator. The operator selects a desired printing mode and enters an input through keys 25. The input may be a command for the apparatus to print a letter. In the event the command is given, the particular letter is known by the electronics of machine 20 to represent a controlled arrangement of dots generated by energizing pixels on head 36 as a tape 98 advances past head 36. When the command to print a letter is given, step motor 240 turns shaft 246. Accordingly, rollers 32, 34 advance the tape 98 past head 36 with the head pixels being variously energized to imprint the letter onto tape 98. After a letter is printed, step motor 240 operates rollers 32, 34 to advance tape 98 a predetermined amount to a point to begin printing of a next inputted letter. Simultaneous with the advancement of tape 98, step motor 240 advances take-up spool 66 so that a fresh portion of tape 68 is opposing the pixels of head 36.

In a preferred embodiment, roller 32 is sized to have a slightly larger diameter than roller 34. Since rollers 32 and 34 are rotated at the same rotations per minute, roller 32 is attempting to advance tape 98 faster than roller 34 can feed tape 98. This action maintains a taut tape between rollers 32, 34. The incremental distance of feed is controlled by roller 34. Roller 32 maintains the tape 98 in a taut condition.

If during operation, tape 98 runs out, the terminal end of tape 98 is sensed by free end detector 40 which sends a signal to the machine 20 electronics by conductors 420. The machine can then cease operation or signal an operator. It will be appreciated that detectors such as detector 40 are commercially available. A very important purpose of detector 40 is to provide safety to an operator and protect the equipment of machine 20. Namely, the electronics of machine 20 will prevent the machine from operating when no tape is detected. This implies no cartridge is mounted on the machine. Accordingly, using the detection of an absence of a tape, the machine 20 will prevent operation of scissor cutter 380 without a cartridge 22 on the machine thereby providing protection to an operator. Also, in the event head 36 and rollers 32, 34 are in their first positions with head 36 spaced from roller 32, the head's pixels would become damaged if they were energized without being urged against a roller to dissipate the generated heat. By not operating after detector 40 notes the absence of a tape 98, this circumstance is avoided.

As the message is being printed, rollers 32 and 34 advance tape 98. The resilient biasing of head 36 against roller 32 and cartridge roller 108 against roller 34, insure uniform pressure on the advancing tape 98. In the event the cartridge is being used for direct thermal printing, first tape system 64 is not present and the imaging process occurs by reason of direct burning by the pixel array of head 36 onto tape 98.

After a desired completed image has been produced onto tape 98, step motor 240 receives a signal to advance the tape out of outlet 91. With the tape 98 so advanced, motor 386 receives a signal through conductors (not shown) to rotate driving gear 398 and consequently move cutting blade 384 toward stationary blade 382 to terminate the tape. After termination has occurred, motor 240 operates to automatically rotate and advance the cutting blade 384 away from the stationary blade 382. As the cutting blade approaches its position fully displaced from the stationary blade 382, first target 407 passes Hall effect transistor which detects the position of target 407 and through conductors (not shown) sends this information to the electronic controls of machine 20. Upon detection of first target 407, motor 386 receives a signal to discontinue rotation.

With the operation completed and the desired tape produced, an operator rotates cartridge lock 38 90° counterclockwise to the position shown in FIG. 2. With this rotation, rollers 32 and 34 and head 36 are automatically moved to their first position with the rollers and head spaced away from the cartridge tapes. Also, as lock control mechanism rotates lock control shaft 234, lock pin 298 comes into alignment with slot 300 whereby spring 294 urges hinge arm 288 upwardly (in the view of FIG. 11) with pin 134 slightly lifting cartridge 22. At this position, the cartridge can be removed by the operator with the spaced apart positioning of the rollers 32, 34 and head 36 permitting quick removal of the tape without damage to the tape within the cartridge 22.

From the foregoing detailed description of the present invention, it has been shown how the object of the invention have been attained in a preferred manner. However, modifications and equivalents of the disclosed concepts such as readily occur to those skilled in the art are intended to be included in the scope of this invention. Thus, the scope of the invention is intended to be limited only by the scope of the claims as are, or may hereafter be, appended hereto.

What is claimed is:

1. A head control apparatus for a printing machine for printing an image on a tape extending through a pathway in a predetermined location on said machine, said head control apparatus comprising:

a frame;

a head for transferring an image to said tape, said head connected to said frame;

a guide connected said frame;

said guide and said head disposed on opposite sides of said pathway;

moving means for moving said guide and said head between respective first and second positions, said guide and said head in said first positions spaced apart a first distance sized to freely position a tape within said pathway, said guide and said head in said second positions disposed for said guide and head to be closely adjacent with a tape within said pathway urged against said head;

said moving means including a carriage movably mounted on said frame, said guide connected to said carriage and movable therewith between said first and second positions, lock means for releasably locking said carriage in a first fixed location when said guide is in said first position and a second fixed location when said guide is in said second position;

said guide including a roller for advancing a tape past said head when said guide and said head are in said second positions; drive means carried on said carriage and connected to said guide to drive said roller and advance a tape past said head;

advancing means carried on said frame and disposed in a predetermined position to drivingly connect with an image source tape to advance said source tape, means for operatively connecting said advancing means to said drive means when said carriage is in said second fixed location and for disconnecting the advancing means from the drive means when the carriage is in the fixed location;

said drive means including a motor carried on said carriage for movement therewith and a gear train operably connecting said motor to said roller;

said advancing means including connector means for making releasable driving connection with said source tape, an advancing means gear connected to said connecting means to urge said connector means to advance said source tape as said gear is rotated;

said connector means and advancing means gear connected to said frame in fixed positions independent of movement of said carriage; and said gear train including a driving gear disposed to operatively engage said advancing means gear when said carriage is in said second fixed location, and said driving gear disposed to be disengaged from said advancing means gear when said carriage is in said first fixed location.

2. A head control apparatus according to claim 1 wherein said head is pivotably mounted on said frame to pivot about a pivot axis toward and away from said predetermined location as said head moves between said first and second positions; biasing means for resiliently biasing said head toward said guide when said head and said guide are in said second positions.

3. A head control apparatus according to claim 2 comprising alignment means for resiliently biasing said head into predetermined alignment in a plane generally parallel to said pivot axis.

4. A head control apparatus according to claim 1 comprising biasing means for resiliently biasing said head toward said guide, and engagement means connected to said carriage for movement therewith and disposed to move said head against the urging of said biasing means away from said second position and toward said first position as said carriage is moved toward said first fixed location.

5. A head control apparatus according to claim 4 wherein said head is pivotable mounted on said frame to pivot about a pivot axis toward and away from said predetermined location as said head moves between said first and second positions.

6. A head control apparatus according to claim 5 comprising alignment means for resiliently biasing said head into predetermined alignment generally parallel to said pivot axis.

7. A head control apparatus according to claim 1 wherein said advancing means includes slip clutch means for interrupting action of said advancing means.

8. A head control apparatus according to claim 1 comprising cutting means disposed adjacent said pathway for terminating a tape extending through said pathway.

9. A head control apparatus according to claim 8 wherein said cutting means includes a motor secured to said frame and a cutting blade disposed adjacent said pathway with gear train means disposed between said motor and said blade for advancing and retracting said blade from said pathway.

10. A head control apparatus according to claim 9 wherein said gear train means includes a gear having an eccentrically mounted pin, said blade connected to a linkage having an elongated slot sized to receive said pin whereby said eccentrically mounted pin rocks said linkage with said rocking linkage advancing and retracting said blade.

11. A head control apparatus according to claim 1 comprising detection means for detecting a free end of a receiving tape on an input side of said pathway.

12. A head control apparatus according to claim 1 wherein said roller is a first roller disposed opposing said head, said apparatus having a second roller disposed on an input side of said head, means for operating said second roller to advance said tape at a rate less than a rate at which said first roller is urging said tape to advance.

13. A head control apparatus according to claim 12 wherein said first roller has a larger diameter than said second roller, said drive means connected to said first and second rollers to rotate said rollers at generally the same rotational speed.

14. A head control apparatus for printing an image on a tape extending through a pathway in a predetermined location on said machine, said head control apparatus comprising:

a frame;

a head for transferring an image to said tape, said head connected to said frame;

a guide connected to said frame;

said guide and said head disposed on opposite sides of said pathway;

moving means for moving said guide and said head between respective first and second positions, said guide and said head in said first positions spaced apart a first distance sized to freely position a tape within said pathway, said guide and said head in said second positions disposed for said guide and head to be closely adjacent with a tape within said pathway urged against said head;

said moving means including a carriage movably mounted on said frame, said guide connected to said carriage and movable therewith between said first and second positions, lock means for releasably locking said carriage in a first fixed location when said guide is in said first position and a second fixed location when said guide is in said second position;

head mounting means for pivotably mounting said head on said frame to pivot about a pivot axis toward and away from said predetermined location as said head moves between said first and second positions;

said moving means further including biasing means for resiliently biasing said head toward said guide, and engagement means connected to said carriage for movement therewith and disposed to move said head against the urging of said biasing means away from said second position and toward said first position as said carriage is moved toward said first fixed location;

said head mounting means including a head mounting bracket pivotably mounted to said frame to pivot about said axis with said head mounting bracket, an alignment bracket pivotably mounted to said frame and having a contact element disposed opposing a first surface of said head mounting bracket in blocking relation to the urging of said biasing means; and said engagement means opposing a predetermined surface of said alignment bracket to engage said predetermined surface and pivot said alignment bracket as said carriage moves toward said first fixed location with said contact element urging said mounting bracket to pivot against urging of said biasing means and move said head toward said first position, said engagement means positioned on said carriage to release said alignment bracket as said carriage is moved toward said second fixed location with said head mounting bracket under urging of said biasing means engaging said contact element and pivoting said alignment bracket as said head moves to said second position.

15. A head control apparatus for a printing machine for printing an image on a tape extending through a pathway in a predetermined location on said machine, said head control apparatus comprising:

a frame;

a head for transferring an image to said tape, said head connected to said frame;

a guide connected to said frame;

said guide and said head disposed on opposite sides of said pathway;

moving means for moving said guide and said head between respective first and second positions, said guide and said head in said first positions spaced apart a first distance sized to freely position a tape within said pathway, said guide and said head in said second positions disposed for said guide and head to be closely adjacent with a tape within said pathway urged against said head;

said moving means including a carriage movably mounted on said frame, said guide connected to said carriage and movable therewith between said first and second positions, lock means for releasably locking said carriage in a first fixed location when said guide is in said first position and a second fixed location when said guide is in said second position; and secondary locking means for locking said carriage in said first fixed position when a tape is not disposed within said pathway, said secondary locking means including means responsive to a presence and absence of a tape cartridge on said printing machine for locking said carriage in said fixed position when a cartridge is absent.

16. A head control apparatus for a printing machine for printing an image on a tape by transferring a printing substance from a source tape to an image receiving tape, said source tape and receiving tape carried in a cartridge of predetermined construction and having means for aligning portions of said source tape and said receiving tape in face-to-face alignment at a predetermined location, said cartridge having openings formed therethrough on opposite sides of said aligned tape portions at said predetermined location, said cartridge having a take-up spool for advancing said source tape with an exposed connecting element constructed to releasably connect with a mating element to drive said take-up spool, said head control apparatus comprising:

a fixed frame;

a carriage movably mounted on said frame;

lock means for releasably locking said carriage in a first fixed location and in a second fixed location;

a roller mounted on said carriage for movement therewith and extending into said cartridge on a side of said predetermined location opposing said receiving tape;

a head connected to said frame and extending into said cartridge on a side of said predetermined location opposing said source tape;

said roller disposed on said carriage to move therewith between a first and second position as said cartridge moves between said first and second locations;

means for moving said head between first and second positions with said head and said roller in said first positions spaced apart a distance sufficient to insert a cartridge on said machine with said tape portions freely inserted between said head and said roller, said head and said roller in said second positions disposed for said roller to urge said tape portions against said head;

a mating element connected to said frame and disposed to mate with said exposed connecting element when said cartridge is inserted on said machine; and drive means carried on said carriage and connected to said roller to drive said roller and releasably connected to said mating element to drive said element when said carriage is in said second fixed location and disengaged from said mating element when said carriage is in said first fixed location.

17. A head control apparatus according to claim 16 wherein said exposed connecting element is a female rotary sprocket and said mating element is a male rotary sprocket.

18. A head control apparatus according to claim 16 wherein said head is pivotably mounted on said frame to pivot about a pivot axis toward and away from said predetermined location as said head moves between said first and second positions; biasing means for resiliently biasing said head toward said roller when said head and said roller are in said second positions.

19. A head control apparatus according to claim 18 comprising alignment means for resiliently biasing said head into predetermined alignment in a plane generally parallel to said pivot axis.

20. A head control apparatus according to claim 18 comprising a head mounting bracket pivotably mounted to said frame to pivot about said axis with said head secured to said head mounting bracket, an alignment bracket pivotably mounted to said frame and having a contact element disposed opposing a first surface of said head mounting bracket in blocking relation to the urging of said biasing means; engagement means connected to said carriage for movement therewith and opposing a predetermined surface of said alignment bracket to engage said predetermined surface and pivot said alignment bracket as said carriage moves toward said first fixed location with said contact element urging said mounting bracket to pivot against the urging of said biasing means and move said head toward said first position, said engagement means positioned on said carriage to release said alignment bracket as said carriage is moved toward said second fixed location with said head mounting bracket under urging of said biasing means engaging said contact element and pivoting said alignment bracket as said head moves to said second position.

21. A head control apparatus according to claim 16 wherein said drive means includes a motor carried on said carriage for movement therewith and a gear train carried on said carriage and operably connecting said motor to said roller, said mating element having a connected gear for driving said mating element and said gear train including a driving gear disposed to operatively engage said connected gear when said carriage is in said second fixed location, and said driving gear disposed to be disengaged from said connected gear when said carriage is in said first fixed location.

22. A head control apparatus according to claim 16 comprising cutting means disposed adjacent said predetermined location for terminating a tape extending through said predetermined location.

23. A head control apparatus according to claim 16 wherein said cartridge has a opening formed therethrough on an input side of said predetermined location, said head control apparatus including detection means extending through said opening for detecting a free end of a receiving tape on an input side of said predetermined location.

24. A head control apparatus for a printing machine for printing an image on a tape extending through a pathway in a predetermined location on said machine, said head control apparatus comprising:

a frame;

a head connected to said frame, said head having means for transferring a desired image onto said tape;

said head disposed on a predetermined side of said pathway;

means for moving said head between a first position and a second position with said head in said first position spaced apart from said pathway, said head in said second position closely adjacent said pathway;

alignment means for maintaining said transfer head in predetermined alignment relative to said pathway;

said means for moving said head including means for pivotably mounting said head on said frame to pivot about a pivot axis toward and away from said predetermined location as said head moves between said first and second positions;

said alignment means including means for resiliently biasing said head into predetermined alignment in a plane generally parallel to said pivot axis and further including a mounting bracket having a first end and a second end, said head connected to said first end and said second end pivotably connected to said frame to pivot about a first pivot axis by a pivot connection with said pivot connection accommodating pivotal movement of said mounting bracket about a second pivot axis generally perpendicular to said first pivot axis; and, spring means for urging said mounting bracket to pivot about said second axis to a position with said maintained in said predetermined alignment.

25. A head control apparatus according to claim 24 wherein said alignment means is resiliently biased to maintained said head in said predetermined alignment.

26. A head control apparatus according to claim 24 wherein said spring means comprises a spring having a body portion resiliently biased to remain in a predetermined plane; attachment means connected to said second end of said mounting bracket for attaching said second end to said leaf spring means with said head maintained in said desired predetermined alignment when said second end is attached to said leaf spring means and said leaf spring means is in said predetermined plane.

* * * * *